US007136616B2

(12) United States Patent
Mandel et al.

(10) Patent No.: US 7,136,616 B2
(45) Date of Patent: Nov. 14, 2006

(54) PARALLEL PRINTING ARCHITECTURE USING IMAGE MARKING ENGINE MODULES

(75) Inventors: Barry Paul Mandel, Fairport, NY (US); Steven R. Moore, Rochester, NY (US); Robert M. Lofthus, Webster, NY (US); Joannes N. M. deJong, Hopewell Junction, NY (US); Lloyd A. Williams, Mahopac, NY (US); Martin Krucinski, Webster, NY (US); Lisbeth S. Quesnel, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 29 days.

(21) Appl. No.: 10/924,459

(22) Filed: Aug. 23, 2004

(65) Prior Publication Data

US 2006/0039729 A1 Feb. 23, 2006

(51) Int. Cl.
*G03G 15/00* (2006.01)

(52) U.S. Cl. ..... 399/388; 399/381

(58) Field of Classification Search ..... 399/381, 399/388, 391, 397

See application file for complete search history.

(56) References Cited

U.S. PATENT DOCUMENTS 4,281,595 A * 8/1981 Fujishiro ..... 101/177
4,397,542 A 8/1983 Brodesser
4,579,446 A 4/1986 Fujino et al.
4,587,532 A 5/1986 Asano
4,591,884 A * 5/1986 Miyamoto et al. ..... 347/153
4,836,119 A 6/1989 Siraco et al.
5,004,222 A 4/1991 Dobashi
5,041,866 A 8/1991 Imoto
5,080,340 A 1/1992 Hacknauer et al.
5,095,342 A 3/1992 Farrell et al.
5,150,167 A * 9/1992 Gonda et al. ..... 399/16
5,159,395 A 10/1992 Farrell et al.
5,208,640 A 5/1993 Horie et al.
5,233,388 A 8/1993 Reese et al.
5,272,511 A 12/1993 Conrad et al.
5,326,093 A 7/1994 Sollitt
5,435,544 A 7/1995 Mandel
5,473,419 A 12/1995 Russel et al.
5,489,969 A 2/1996 Soler et al.
5,504,568 A 4/1996 Saraswat et al.
5,525,031 A 6/1996 Fox
5,557,367 A 9/1996 Yang et al.
5,568,246 A * 10/1996 Keller et al. ..... 399/382
5,570,172 A 10/1996 Acquaviva
5,596,416 A 1/1997 Barry et al.
5,629,762 A 5/1997 Mahoney et al.
5,699,735 A * 12/1997 Stein et al. ..... 101/219
5,710,968 A 1/1998 Clark et al.

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Anthony H. Nguyen
(74) *Attorney, Agent, or Firm*—Eugene O. Palazzo; Fay, Sharpe, Fagan, Minnich & McKee, LLP

(57) ABSTRACT

An integrated printing system is provided and includes at least two generally vertically aligned image marking engines and at least two generally horizontally aligned image marking engines. The printing system further includes at least one generally horizontal interface media transport for transporting media between and to the vertically aligned and the horizontally aligned image marking engines.

40 Claims, 6 Drawing Sheets

U.S. PATENT DOCUMENTS

| | | | | |
|---|---|---|---|---|
| 5,778,377 | A | 7/1998 | Marlin et al. | |
| 5,842,095 | A * | 11/1998 | Kitamura | 399/299 |
| 5,884,910 | A | 3/1999 | Mandel | |
| 5,995,721 | A | 11/1999 | Rourke et al. | |
| 6,059,284 | A | 5/2000 | Wolf et al. | |
| 6,125,248 | A | 9/2000 | Moser | |
| 6,241,242 | B1 | 6/2001 | Munro | |
| 6,297,886 | B1 | 10/2001 | Cornell | |
| 6,332,663 | B1 | 12/2001 | Puzio | |
| 6,341,773 | B1 | 1/2002 | Aprato et al. | |
| 6,384,918 | B1 | 5/2002 | Hubble, III et al. | |
| 6,450,711 | B1 * | 9/2002 | Conrow | 400/582 |
| 6,476,376 | B1 | 11/2002 | Biegelsen et al. | |
| 6,476,923 | B1 | 11/2002 | Cornell | |
| 6,493,098 | B1 * | 12/2002 | Cornell | 358/1.12 |
| 6,537,910 | B1 | 3/2003 | Burke et al. | |
| 6,550,762 | B1 | 4/2003 | Stoll | |
| 6,554,276 | B1 | 4/2003 | Jackson et al. | |
| 6,577,925 | B1 | 6/2003 | Fromherz | |
| 6,607,320 | B1 | 8/2003 | Bobrow et al. | |
| 6,608,988 | B1 | 8/2003 | Conrow | |
| 6,612,566 | B1 | 9/2003 | Stoll | |
| 6,612,571 | B1 | 9/2003 | Rider | |
| 6,621,576 | B1 | 9/2003 | Tandon et al. | |
| 6,633,382 | B1 | 10/2003 | Hubble, III et al. | |
| 6,639,669 | B1 | 10/2003 | Hubble, III et al. | |
| 6,819,906 | B1 | 11/2004 | Herrmann et al. | |
| 2002/0078012 | A1 | 6/2002 | Ryan et al. | |
| 2002/0103559 | A1 | 8/2002 | Gartstein | |
| 2003/0077095 | A1 | 4/2003 | Conrow | |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0150156 | A1 | 8/2004 | Fromherz et al. | |
| 2004/0150158 | A1 | 8/2004 | Biegelsen et al. | |
| 2004/0153983 | A1 | 8/2004 | McMillan | |
| 2004/0216002 | A1 | 10/2004 | Fromherz et al. | |
| 2004/0225391 | A1 | 11/2004 | Fromherz et al. | |
| 2004/0225394 | A1 | 11/2004 | Fromherz et al. | |
| 2004/0247365 | A1 | 12/2004 | Lofthus et al. | |

OTHER PUBLICATIONS

Desmond Fretz, "Cluster Printing Solution Announced", Today at Xerox (TAX), No. 1129, Aug. 3, 2001.

U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/001,890, filed Dec. 2, 2004, Lofthus et al.
U.S. Appl. No. 11/002,528, filed Dec. 2, 2004, Lofthus et al.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/120,589, filed May 3, 2005, Contino.
U.S. Appl. No. 11/102,332, filed Apr. 8, 2005, Hindi et al.

* cited by examiner

PARALLEL PRINTING ARCHITECTURE USING IMAGE MARKING ENGINE MODULES

BACKGROUND

U.S. patent application Ser. No. 10/917,768, filed Aug. 13, 2004; U.S. patent application Ser. No. 10/924,106, filed Aug. 23, 2004; U.S. patent application Ser. No. 10/924,113, filed Aug. 23, 2004; and U.S. patent application Ser. No. 10/924,458, filed Aug. 23, 2004.

There is disclosed herein in embodiments a plurality of image marking engines or image recording apparatuses providing a multifunctional and expandable printing system. It finds particular application in conjunction with integrated printing modules consisting of several marking engines, each having the same or different printing capabilities, and will be described with particular reference thereto. However, it is to be appreciated that the illustrations of embodiments herein are also amenable to other like applications.

Various apparatuses, i.e. xerographic imaging system, for recording images on sheets have heretofore been put into practical use. For example, there are copying apparatuses of the type in which the images of originals are recorded on sheets through a photosensitive medium or the like, and printers in which image information transformed into an electrical signal is reproduced as an image on a sheet by an impact system (the type system, the wire dot system or the like) or a non-impact system (the thermosensitive system, the ink jet system, the laser beam system or the like).

The marking engine of an electronic reprographic printing system or xerographic imaging system is frequently an electrophotographic printing machine. In such a machine, a photoconductive belt is charged to a substantially uniform potential to sensitize the belt surface. The charged portion of the belt is thereafter selectively exposed. Exposure of the charged photoconductive belt or member dissipates the charge thereon in the irradiated areas. This records an electrostatic latent image on the photoconductive member corresponding to the informational areas contained within the original document being reproduced. After the electrostatic latent image is recorded on the photoconductive member, the latent image on the photoconductive member is subsequently transferred to a copy sheet. The copy sheet is heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complementary thereto. This process is repeated a plurality of cycles for differently colored images and their respective complementarily colored toner. Each single color toner image is transferred to the copy sheet in superimposed registration with the prior toner image. This creates a multi-layered toner image on the copy sheet. Thereafter, the multi-layered toner image is permanently affixed to the copy sheet creating a color copy. The developer material may be a liquid or a powder material.

In the process of black and white printing, the copy sheet is advanced from an input tray to a path internal the electrophotographic printing machine where a toner image is transferred thereto and then to an output catch tray for subsequent removal therefrom by the machine operator. In the process of multi-color printing, the copy sheet moves from an input tray through a recirculating path internal the printing machine where a plurality of toner images is transferred thereto and then to an output catch tray for subsequent removal. With regard to multi-color printing, as one example, a sheet gripper secured to a transport receives the copy sheet and transports it in a recirculating path enabling the plurality of different color images to be transferred thereto. The sheet gripper grips one edge of the copy sheet and moves the sheet in a recirculating path so that accurate multi-pass color registration is achieved. In this way, magenta, cyan, yellow, and black toner images are transferred to the copy sheet in registration with one another.

Additionally, it is common practice to record images not only on one surface of the sheet, but also on both surfaces of a sheet. Copying or printing on both sides of a sheet decreases the number of sheets used from the viewpoint of saving of resources or filing space. In this regard as well, a system has been put into practical use whereby sheets having images recorded on a first surface thereof are once accumulated and after the recording on the first surface is completed, the accumulated sheets are then fed and images are recorded on a second surface thereof. However, this system is efficient when many sheets having a record of the same content are to be prepared, but is very inefficient when many sheets having different records on both surfaces thereof are to be prepared. That is, when pages 1, 2, 3, 4, . . . are to be prepared, odd pages, i.e. pages 1, 3, 5, . . . , must first be recorded on the first surface of the respective sheets, and then these sheets must be fed again and even pages 2, 4, 6, . . . must be recorded on the second surface of the respective sheets. If, during the second feeding, multiplex feeding or jam of sheets should occur, the combination of the front and back pages may become mixed, thereby necessitating recording be done over again from the beginning. To avoid this, recording may be effected on each sheet in such a manner that the front and back surfaces of each sheet provide the front and back pages, respectively, but this takes time for the refeeding of sheets and the efficiency is reduced. Also, in the prior art methods, the conveyance route of sheets has been complicated and further, the conveyance route has unavoidably involved the step of reversing sheets, and this has led to extremely low reliability of sheet conveyance.

Also, there exist further requirements to record two types of information on one surface of a sheet in superposed relationship. Particularly, recently, coloring has advanced in various fields and there is also a desire to mix, for example, color print with black print on one surface of a sheet. As a simple method for effecting a superposed relationship, there exists systems whereby recording is once effected in black, whereafter the developing device in the apparatus is changed from a black one to a color one, and recording is again effected on the same surface. This system requires an increase in time and labor.

Where two types of information are to be recorded on one surface of the same sheet in superposed relationship, sufficient care must be taken of the image position accuracy, otherwise the resultant copy may become very unsightly due to image misregistration or deviation from a predetermined image recording frame.

In recent years, the demand for even higher productivity and speed has been required of these image recording apparatuses. However, the respective systems have their own speed limits and if an attempt is made to provide higher speeds, numerous problems will occur and/or larger and more bulky apparatuses must be used to meet the higher speed demands. The larger and bulkier apparatuses, i.e. high speed printers, typically represent a very expensive and uneconomical apparatus. The expense of these apparatuses along with their inherent complexity can only be justified by the small percentage of extremely high volume printing customers.

U.S. Pat. No. 4,591,884 to Miyamoto et al.; U.S. Pat. No. 5,208,640 to Horie et al.; and U.S. Pat. No. 5,041,866 to Imoto are incorporated by reference as background information.

BRIEF DESCRIPTION

In accordance with one aspect of the illustrated embodiments, a new and improved integrated printing system is provided. In one embodiment, the printing system includes at least two generally vertically aligned image marking engines and at least two generally horizontally aligned image marking engines. At least one interface media transport is provided for transporting media to the at least two vertically aligned and the at least two horizontally aligned image marking engines.

According to another embodiment, an integrated printing system is provided including at least two generally vertically aligned image marking engines and least two generally horizontally aligned image marking engines. At least one generally horizontal interface media transport is provided for transporting media from one image marking engine to at least another image marking engine in the system.

According to still another embodiment, a method for printing media adapted for a plurality of image marking engines is provided. The method comprises: providing at least two generally vertically aligned image marking engines; providing at least two generally horizontally aligned image marking engines; feeding media from at least one feeding source into the generally vertically aligned and the generally horizontally aligned image marking engines; and, transporting the media from the vertically aligned image marking engines and the horizontally aligned image marking engines into at least one media exit portion.

In accordance with a further embodiment, an integrated printing system is provided including at least one generally horizontal interface media transport extending from a media feed source to a media finishing portion. The system further includes at least one additional media transport for connecting the at least one horizontal interface media transport with at least one image marking engine. The at least one additional media transport includes an inverter for enabling single pass duplexing between the at least one image marking engine and another image marking engine. The at least one image marking engine and the another image marking engine are generally vertically aligned.

In accordance with yet another embodiment, an integrated printing system is provided including a plurality of image marking engines selectively connected to one another and aligned in a generally vertical and horizontal arrangement. Each image marking engine can include at least one entrance media path and at least one exit media path. The system further includes an interface media transport linking at least one of the at least one entrance media path and the at least one exit media path of the each image marking engine.

DETAILED DESCRIPTION

Figure 1:
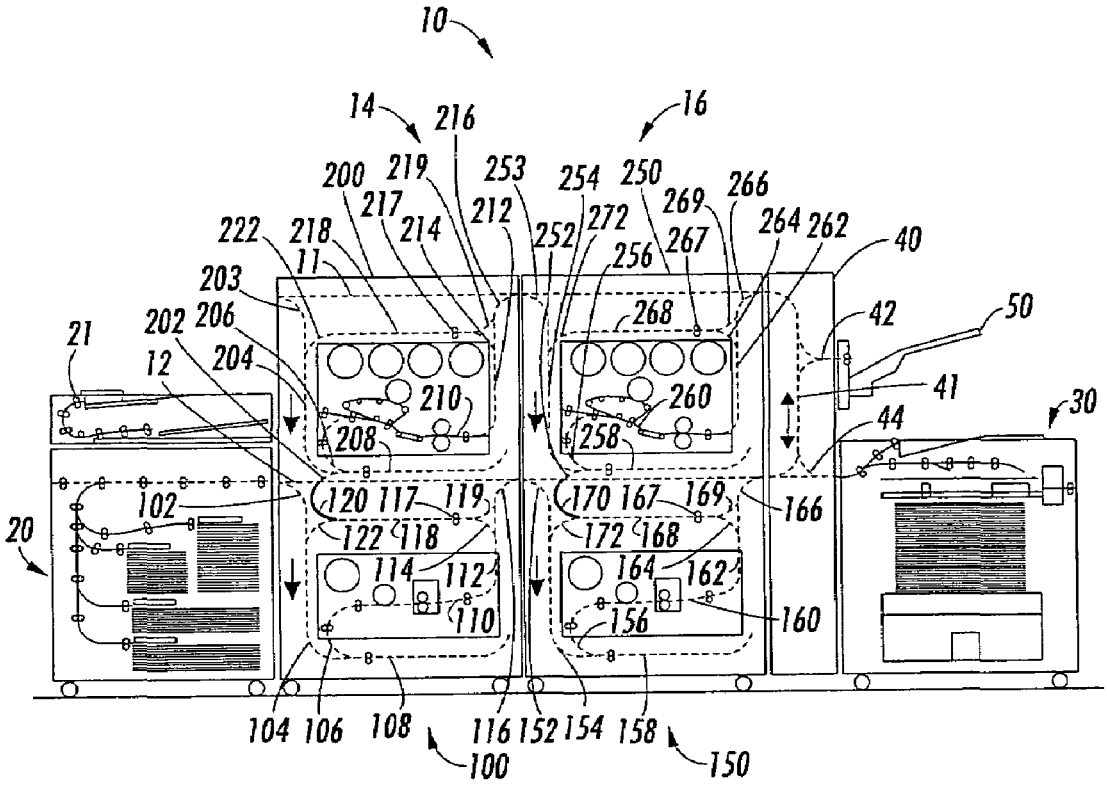
FIG. 1 is a sectional view showing an arrangement of image marking engines according to a first embodiment.

While the present printing apparatus and method will hereinafter be described in connection with exemplary embodiments, it will be understood that it is not intended to limit the embodiments. On the contrary, it is intended to cover all alternatives, modifications and equivalents as may be included within the spirit and scope of the embodiments as defined by the appended claims.

The embodiments, to be described below, consist of a plurality of Image Marking Engines (IME). The IMEs can be, for example, any type of ink-jet printer, a electrophotographic printer, a thermal head printer that is used in conjunction with heat sensitive paper, or any other apparatus used to mark an image on a substrate. The IMEs can be, for example, black only (monochrome) and/or color printers. Examples of different varieties of black and color printers are shown in the FIGS. 1–6, but other varieties, types, alternatives, quantities, and combinations can be used within the scope of the exemplary embodiments. It is to be appreciated that, each of the IMEs can include an input/output interface, a memory, a marking cartridge platform, a marking driver, a function switch, a controller and a self-diagnostic unit, all of which can be interconnected by a data/control bus. Each of the IMEs can have a different processing speed capability.

Each marking engine can be connected to a data source over a signal line or link. The data source provides data to be output by marking a receiving medium. In general, the data source can be any of a number of different sources, such as a scanner, a digital copier, a facsimile device that is suitable for generating electronic or xerographic image data, or a device suitable for storing and/or transmitting the electronic image data, such as a client or server of a network, or the internet, and especially the worldwide web. The data source may also be a data carrier such as a magnetic storage disk, CD ROM, or the like, that contains data to be output by marking. Thus, the data source can be any known or later developed source that is capable of providing scanned and/or synthetic data to each of the marking engines.

The link can be any known or later developed device or system for connecting the image data source to the marking engine, including a direct cable connection, a public switched telephone network, a wireless transmission channel, a connection over a wide area network or a local area network, a connection over an intranet, a connection over the internet, or a connection over any other distributed processing network or system. In general, the link can be any known or later developed connection system or structure usable to connect the data source to the marking engine. Further, it should be appreciated that the data source may be connected to the marking engine directly.

As shown in FIGS. 1–4 and 6 and to be described hereinafter, multiple marking engines are shown tightly coupled to or integrated with one another in a variety of combinations thereby enabling high speed printing and low run costs, with a high level of up time and system redundancy.

Referring to FIG. 1, a printing system 10 having a modular architecture is shown which employs a vertical frame structure that can hold at least two marking engines and provides horizontal media paths or transport highways 11, 12. The modular architecture can alternatively include a separate frame structure around each marking engine and/or transport highway. The frame structure contains features to allow both horizontal and vertical docking of the marking engines. The frame structure includes horizontal and vertical walls compatible with other marking engines. The two image marking engines can be cascaded together with any number of other marking engines to generate higher speed configurations. It is to be appreciated that each marking engine can be disconnected (i.e. for repair) from the printing system while the rest of the system retains its processing capability.

By way of example, an integrated printing system 10 having two vertical towers 14, 16 comprising four IMEs 100, 150, 200, 250 is shown in FIG. 1. The integrated printing system 10, as shown, further includes a paper/media feeding portion 20, a document scanner 21, and a paper/media finishing or exit portion 30. Between the feeding portion 20 and the finishing portion 30 are the four contained and integrated image marking engines 100, 150, 200, 250. In FIG. 1, two color marking engines 200, 250 are shown mounted above two black marking engines 100, 150. It is to be appreciated that more and other combinations of color and black marking engines can be utilized in any number of configurations. Also shown is an exit or output merge module 40 which merges horizontal media transport highway 12 together with horizontal highway 11 (by way of a bidirectional media path 41), provides alternate output locations 42, 44, and receives sheets from both horizontal highways 11, 12.

In operation, media exits the feeding portion 20 onto the horizontal media highway 12 whereby the media enters the integrated marking engines area 100, 150, 200, 250. Although not shown, it is to be appreciated that feeding portion 20, or another feeding portion, could feed media directly to horizontal highway 11. The media can initially enter any one of the image marking engines 100,150, 200, 250. If, for example, the media is to be processed through a black only marking engine on one side of the media, the paper can be delivered to marking engine 100 or 150 for processing by way of horizontal highway 12. In this example, the media would exit the horizontal highway 12 at points 102 or 152 and proceed along path 104 or path 154, respectively. The media enters IMEs 100, 150 at entrance points 106, 156.

With reference to one of the marking engines, namely marking engine 100, the media paths are detailed below. The media originating from the feeding portion 20 enters horizontal highway 12. The media exits the horizontal highway 12 at highway exit 102. Upon exiting the horizontal highway 12, the media travels generally vertically along path 104 into a staging portion or inverter 108. Thereupon, the media enters the processing portion of marking engine 100 at point 106 and is transported through a processing path 110 of the marking engine 100 whereby the media receives an image. Next, the media exits the processing path 110 at point 112 and can take alternate routes therefrom. Namely, the media can be recirculated, through an internal duplex loop 114, 118 back towards the feeding portion 20, or can travel by path 116 to horizontal highway 12 for exiting the IME 100 and optionally entering another marking engine 150 or 250. Optionally, the media can be inverted by an inverter 117 by way of paths 114 and 119 prior to exiting the IME 100. If the media is moved back into a duplex path portion 114, 118, the media can be moved from the initial marking engine 100 to marking engine 200 by way of a single pass duplex path 120 or can be recirculated back into the initial marking engine 100 by way of paths 122 and 104.

The architecture, described above, enables the use of multiple marking engines within the same system and can provide single pass duplexing, internal pass duplexing, and multi-pass printing. Single pass duplexing refers to a system in which side 1 of a sheet is printed on one marking engine, and side 2 is printed on a second marking engine instead of recirculating the sheet back into the first engine. In contrast, internal pass duplexing refers to a system in which side 1 and side 2 are printed on a single marking engine wherein the sheet is recirculated back into the same engine for printing of side 2. The single pass duplex media path 120, for example, enables duplexing to be accomplished within the tower 14. Alternatively, the internal duplex loops and paths 114, 118, 122 enable duplex printing to continue within a single IME (i.e. IME 100) even when one or more of the other marking engines are down for service prohibiting single pass duplexing. Multi-pass printing refers to a system in which side one of a sheet is printed on one marking engine, and the same side one is printed on a second marking engine.

In the configuration of FIG. 1, it is to be appreciated that single pass duplexing can be accomplished alternatively by two other marking engines, for example IMEs 100 and 150, oriented generally horizontally to one another, where the second IME 150 is positioned downstream from the first or originating marking engine 100. Alternatively, single pass duplexing can be accomplished by marking engines 100 and 250 oriented horizontally and vertically, or spaced apart (non-adjacent), to one another.

The highways 11, 12 can be used to deliver sheets (media) to the marking engines 100, 150, 200, 250 and transport printed sheets away from the marking engines. As shown in FIG. 1, the second horizontal highway 11 which also moves media from left to right (forward), is shown positioned above the pair of vertical towers 14, 16. The media highways 11, 12 also transport sheets between the marking engines and to the output devices 40, 30. This process evens out the load on a highway, since blank sheets are leaving the highway, moving left to right, while printed sheets are joining the highway. The exit module 40 can be used to provide multiple output locations as well as provide inverting and merging functions. As shown in FIG. 1, the directional movement of paths 11, 12 is generally left to right from the feeding portion 20 to the finishing portion 30. It is to be appreciated that paths 11 and 12, or segments thereof, and connecting transport paths, can intermittently reverse to allow for transport path routing changes of selected media. It is to be appreciated that the entire system can be mirror imaged and media moved in opposite directions.

The media paths of the other marking engines are described in detail below. With reference to another marking engine, namely marking engine 150, the media paths are detailed below. The media originating from the feeding portion, or IME 100, enters or re-enters the horizontal highway 12. The media can exit the horizontal highway 12 at highway exit 152. Upon exiting the horizontal highway 12, the media travels generally vertically along the path 154 into a staging portion or inverter 158. Thereupon, the media enters the processing portion of marking engine 150 at point 156 and is transported along a processing path 160 of the marking engine 150 whereby the media receives the image. Next, the media exits the processing path 160 at point 162 and can take alternate routes therefrom. Namely, the media can be recirculated, through an internal duplex loop 164, back towards the direction of the feeding portion, or can travel by path 166 back to the horizontal highway 12 for exiting the system 10. Optionally, the media can be inverted by an inverter 167 by way of paths 164 and 169 prior to exiting the IME 150. If the media is moved back into a duplex path portion 168, the media can be moved from the marking engine 150 to another marking engine 250 by way of a single pass duplex path 170 or can be recirculated back into marking engine 150 by way of path 172 and 154.

With reference now to another marking engine, namely marking engine 200, the media paths are detailed below. The media originating from the feeding portion, or through IME 100, enters or re-enters the horizontal highway 12. Although not shown, it is to be appreciated that feeding portion 20, or another feeding portion, could feed media directly to horizontal highway 11. The media can exit the horizontal highways 11, 12 at highway exits 203, 202. Upon exiting the horizontal highway 12, the media travels into a staging portion or inverter 208 by way of exit path 202. Thereupon, the media enters the processing portion of IME 200 at point 206 and is transported through a processing path 210 of the marking engine 200 whereby the media receives the image. Next, the media exits the processing portion 210 at point 212 and can take alternate routes therefrom. Namely, the media can be recirculated, through an internal duplex loop 214, back towards the direction of the feeding portion, or can travel by path 216 to the horizontal highway 11 for exiting the system or entering another marking engine 250. Optionally, the media can be inverted by an inverter 217 by way of paths 214 and 219 prior to exiting the IME 200. If the media is moved back into a duplex path portion 218, the media can be recirculated back into marking engine 200 by way of path 222 and 204. It is to be appreciated that single pass duplexing can also be accomplished by marking engines 200 and 250 oriented generally horizontally to one another.

With reference to another marking engine, namely marking engine 250, the media paths are detailed below. The media originating from the feeding portion 20 enters one or both of the horizontal highways 11, 12, either directly or indirectly via another IME. The media can exit the horizontal highways 12, 11 at highway exits 252 or 253. Upon exiting the horizontal highways, the media travels into a staging portion or inverter 258. It is to be appreciated that the media can come to inverter 258 directly, or indirectly via marking engines 100, 150 and/or 200. Thereupon, the media enters the processing portion of IME 250 at point 256 and is transported through a processing path 260 of the marking engine 250 whereby the media receives an image. Next, the media exits the processing portion 260 at point 262 and can take alternate routes therefrom. Namely, the media can be recirculated, through an internal duplex loop 264 back towards the direction of the feeding portion, or can travel by path 266 to the horizontal highway 11 for exiting the system. Optionally, the media can be inverted by an inverter 267 by way of paths 264 and 269 prior to exiting the IME 250. If the media is moved back into a duplex path portion 268, the media can be recirculated back into marking engine 250 by way of paths 272 and 254.

As described above, the single pass duplex path 170 enables duplexing to be accomplished between generally vertically aligned marking engines 150 and 250. It is to be appreciated that single pass duplexing can also be accomplished by marking engines 200 and 250 or 100 and 250, for example, where the second IME 250 is positioned downstream from the first IMEs 200 and 100.

The media traveling to the terminal ends of the horizontal highways enter the output merge module 40. The output merge module 40 collects or receives media from both upper and lower highways 11, 12, moves media therebetween by way of path 41, and delivers them in sequence to the media finishing device or portion 30 via path 44 or delivers them directly to an output tray 50 via path 42. It is to be appreciated that the sheet entry and exit points are preferably at a standard height to permit use of existing, or standard, input/output modules. Generally, the sheets pass through the system from left to right on one or more horizontal media highways 11, 12, but it is to be appreciated that one or more of the highways can pass sheets from right to left (to be explained in more detail below). It is to be appreciated that the entire system can be mirror imaged and media moved in opposite directions.

Although not illustrated, it is to be appreciated that at intersections along the horizontal highways and at alternative routes entering and exiting the IMEs, switches or dividing members are located and constructed so as to be switchable to allow sheets or media to move along one path or another depending on the desired route to be taken. The switches or dividing members can be electrically switchable between at least a first position and a second position. An enabler for reliable and productive system operation includes a centralized control system that has responsibility for planning and routing sheets, as well as controlling the switch positions, through the modules in order to execute a job stream.

Figure 2:
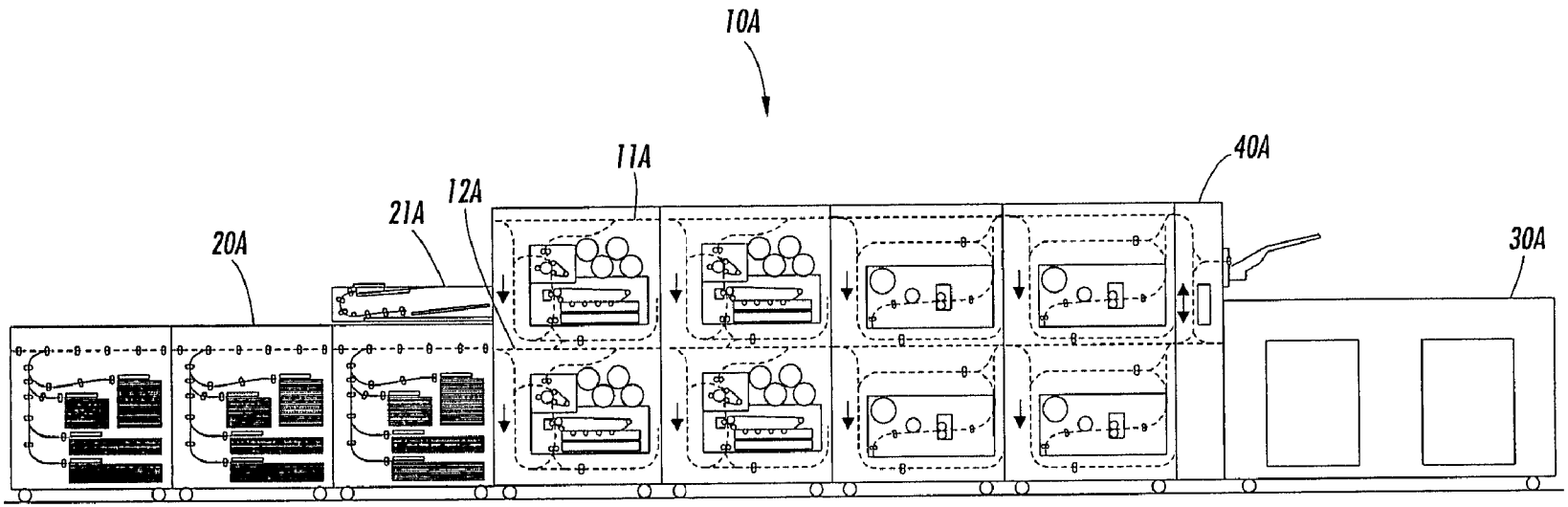
FIG. 2 is a sectional view showing an arrangement of image marking engines according to a second embodiment.

The printing system can be integrated and expanded in a variety of configurations. By way of illustration, another printing system 10A is shown in FIG. 2. The printing system 10A illustrates eight IMEs (four color and four black), three media feed sources 20A, one document scanner 21A, one output merge module 40A, and two finishing/stacking portions 30A. Media transport is by way of two generally horizontal highways 11A, 12A.

Figure 3A:
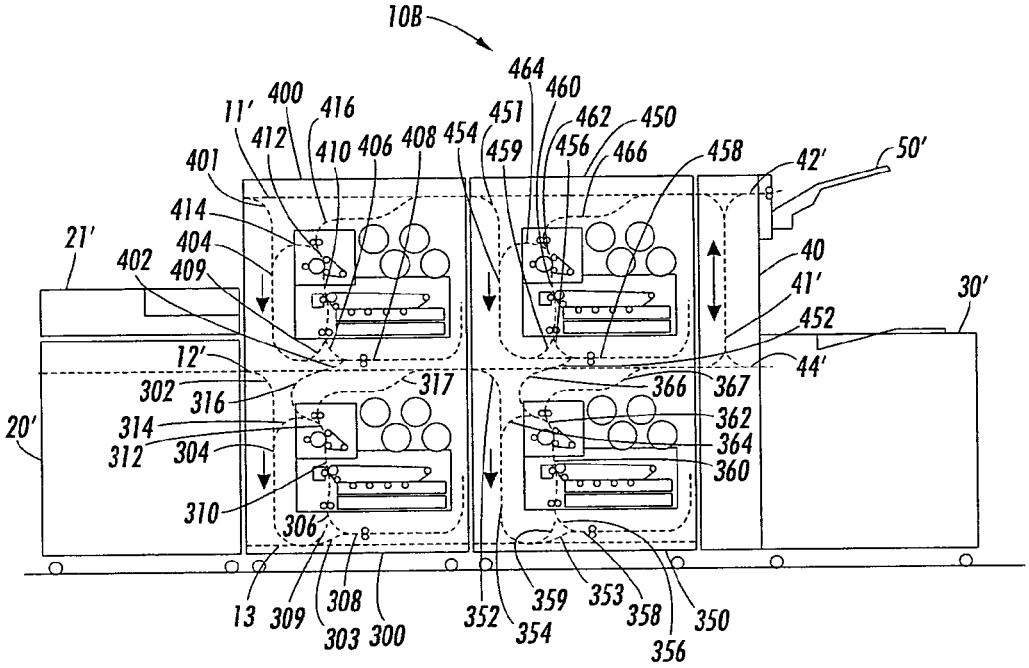
FIG. 3A is a sectional view showing an arrangement of image marking engines according to a third embodiment.

Referring now to FIG. 3A, yet another alternative configuration of an integrated printing system 10B is therein illustrated. The system of FIG. 3 includes four marking engines 300, 350, 400, 450. Similar elements are identified with a single prime (') suffix and new elements are identified with new numerals. A media feeding portion 20', an output merge module 40', and a media finishing portion 30' are displayed. In FIG. 3, the system includes one central highway 12', one highway above the marking engines 11', and one highway 13 below the marking engines. Each of the marking engines 300, 350, 400, 450 can include an internal duplex loop path (described in detail below).

In operation, media exits the feeding portion 20' onto the horizontal media highways 11', 12', 13 whereby the media enters the integrated marking engines area 300, 350, 400, 450. The media can initially enter any one of the image marking engines 300, 350, 400, 450 directly.

With reference to one of the marking engines, namely marking engine 300, the media paths are described below. The media originating from the feeding portion 20' enters, for example, horizontal highway 12'. The media can exit the horizontal highway 12' at highway exit 302. Upon exiting the horizontal highway 12', the media travels generally vertically along path 304 to horizontal highway 13. The media can then exit highway 13 by way of path 303 and proceed into a staging portion or inverter 308, or travel along highway 13 to IME 350. Alternatively, the media can bypass the inverter 308 via path 309. If the media enters the processing portion of marking engine 300, the media enters at point 306 and is transported through a processing path 310 of the marking engine 300 whereby the media receives an image. Next, the media exits the processing path 310 at point 312 and can take alternate routes therefrom. Namely, the media can be recirculated, through an internal duplex loop 314 back towards the feeding portion 20', or can travel by path 316 or 317 to horizontal highway 12' for exiting the IME 300 and optionally entering another marking engine. If the media is moved back into the single pass duplex path portion 316, the media can be moved from the initial marking engine 300 to marking engine 400 by way of paths 316 and 402, for example. If the media follows path 317 to horizontal highway 12', then the media can enter another IME 350, 450, or enter output merge module 40'. It is to be appreciated that the architecture, described above, enables the use of different marking engines within the same system and can provide single pass duplexing as well as internal pass duplexing.

In the configuration of FIG. 3A, it is to be appreciated that single pass duplexing can be accomplished by alternative combinations of two marking engines, for example IMEs 300 and 350, oriented horizontally to one another, where the second IME 350 is positioned downstream from the first or originating marking engine 300. Alternatively, single pass duplexing can be accomplished by marking engines 300 and 450 oriented horizontally and vertically, or spaced apart (non-adjacent), to one another.

The highways 11', 12' and 13 can be used to deliver sheets (media) to the marking engines 300, 350, 400, 450, and to transport sheets between marking engines. Highways 11', 12' can also transport printed sheets away from the marking engines to the output merge module 40'. This process evens out the load on the highways, since blank sheets are leaving the highway, moving left to right, while printed sheets are joining the highway.

The media paths of the other marking engines are described in detail below. With reference to another marking engine, namely marking engine 350, the media originating from the feeding portion, or IME 300, enters or re-enters the horizontal highway 12' and/or 13. The media can exit the horizontal highways 12', 13 at highway exits 352, 353, 359. Upon exiting the horizontal highway 12', the media travels generally vertically along the path 354 to horizontal highway 13. The media can then proceed into a staging portion or inverter 358, bypass the inverter 358 via path 359, or travel to another IME (not illustrated). Media enters the processing portion of marking engine 350 at point 356 and is transported along a processing path 360 of the marking engine 350 whereby the media receives an image. Next, the media exits the processing path 360 at point 362 and can take alternate routes therefrom. Namely, the media can be recirculated, through an internal duplex loop 364, back towards the direction of the feeding portion, or can travel by path 366 or 367 back to the horizontal highway 12' for optionally entering another marking engine 450 or exiting the system 10B. If the media is moved back into the single pass duplex path portion 366, the media can be moved from the marking engine 350 to another marking engine 450 by way of paths 366 and 452. If the media follows path 367 to horizontal highway 12', then the media can enter output merge module 40'. The media alternatively can be recirculated back into marking engine 350 by way of paths 364 and 354.

With reference now to another marking engine, namely marking engine 400, the media paths are explained below. The media originating from the feeding portion, or IME 300, enters or re-enters the horizontal highway 12'. Although not shown, it is to be appreciated that feeding portion 20', or another feeding portion, could feed media directly to horizontal highway 11'. The media can exit the horizontal highways 11', 12' at highway exits 401, 402. Upon exiting the horizontal highway 12', the media travels into a staging portion or inverter 408. Thereupon, the media enters the processing portion of IME 400 at point 406 and is transported through a processing path 410 of the marking engine 400 whereby the media receives the image. Next, the media exits the processing portion 410 at point 412 and can take alternate routes therefrom. Namely, the media can be recirculated, through an internal duplex loop 414, back towards the direction of the feeding portion or can travel by path 416 to the horizontal highway 11' for exiting the system or entering another marking engine 450. If the media is moved back into a duplex path portion 414, the media can be recirculated back into marking engine 400 by way of path 404. The media can bypass the inverter 408, prior to entering the processing portion of IME 400, by way of paths 404 and 409.

With reference to another marking engine, namely marking engine 450, the media paths are explained below. The media originating from the feeding portion 20' enters one or both of the horizontal highways 11', 12', either directly or indirectly via another IME. The media can exit the horizontal highways at highway exits 451 or 452. Upon exiting the horizontal highway 12', the media travels into a staging portion or inverter 458. It is to be appreciated that the media can come to inverter 458 directly, or indirectly via marking engines 300, 350 and/or 400. Optionally, media exiting highway 11' can bypass inverter 458 via paths 454 and 459. Media enters the processing portion of IME 450 at point 456 and are transported through a processing path 460 of the marking engine 450 whereby the media receives an image. Next, the media exits the processing portion 460 at point 462 and can take alternate routes therefrom. Namely, the media can be recirculated, through an internal duplex loop 464 back towards the direction of the feeding portion, or can travel by path 466 to the horizontal highway 11' for exiting the system. If the media is moved back into the duplex path portion 464, the media can be recirculated back into marking engine 450 by way of paths 454 and 459 (or 458).

The single pass duplex path 366 and 452 enables duplexing to be accomplished between generally vertically aligned marking engines 350 and 450. It is to be appreciated that single pass duplexing can also be accomplished by marking engines 400 and 450 and/or 300 and 450, for example, where the second IME 450 is positioned downstream from the first IMEs 400 or 300. The internal duplex loops, and inverter bypasses, function as a multi-pass loop for color processing where different colors are transmitted to a single side of the media, for example. As described above, the optional inverter allows copying to both sides of the media by a single marking engine.

The media traveling to the terminal ends of the horizontal highways 11', 12' enter the output merge module 40'. The output merge module 40' collects or receives media from both highways 11', 12', moves media therebetween by way of path 41, and delivers them in sequence to the media finishing device or stacker portion 30' via path 44' or delivers them directly to an output tray 50' via path 42'.

Figure 3B:
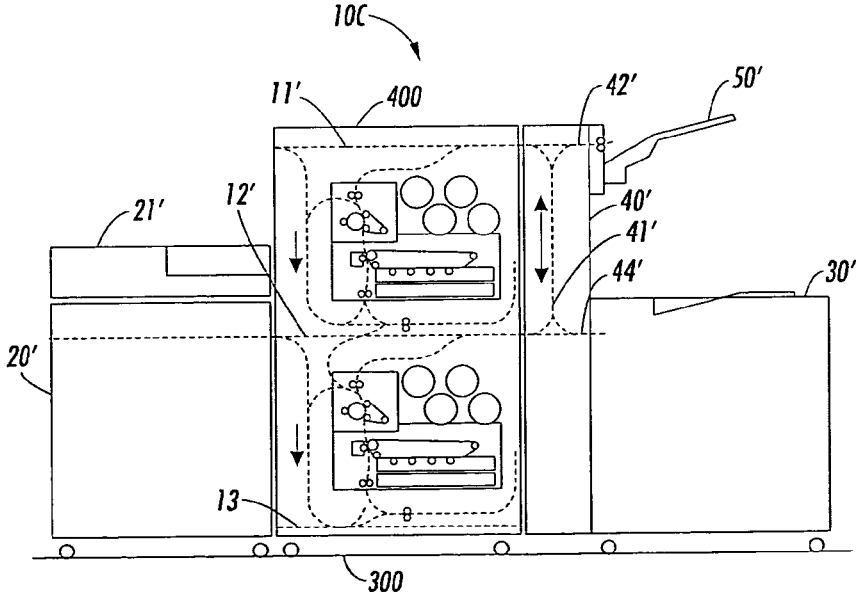
FIG. 3B is a sectional view showing an arrangement of image marking engines according to a fourth embodiment.

It is to be appreciated that the modular architecture allows marking engines to be added and removed from a printing system. With reference to FIG. 3B, another combination of marking engines configured into an integrated printing system 10C is therein illustrated. The system 10C includes two marking engines 300, 400 generally vertically aligned.

Figure 4:
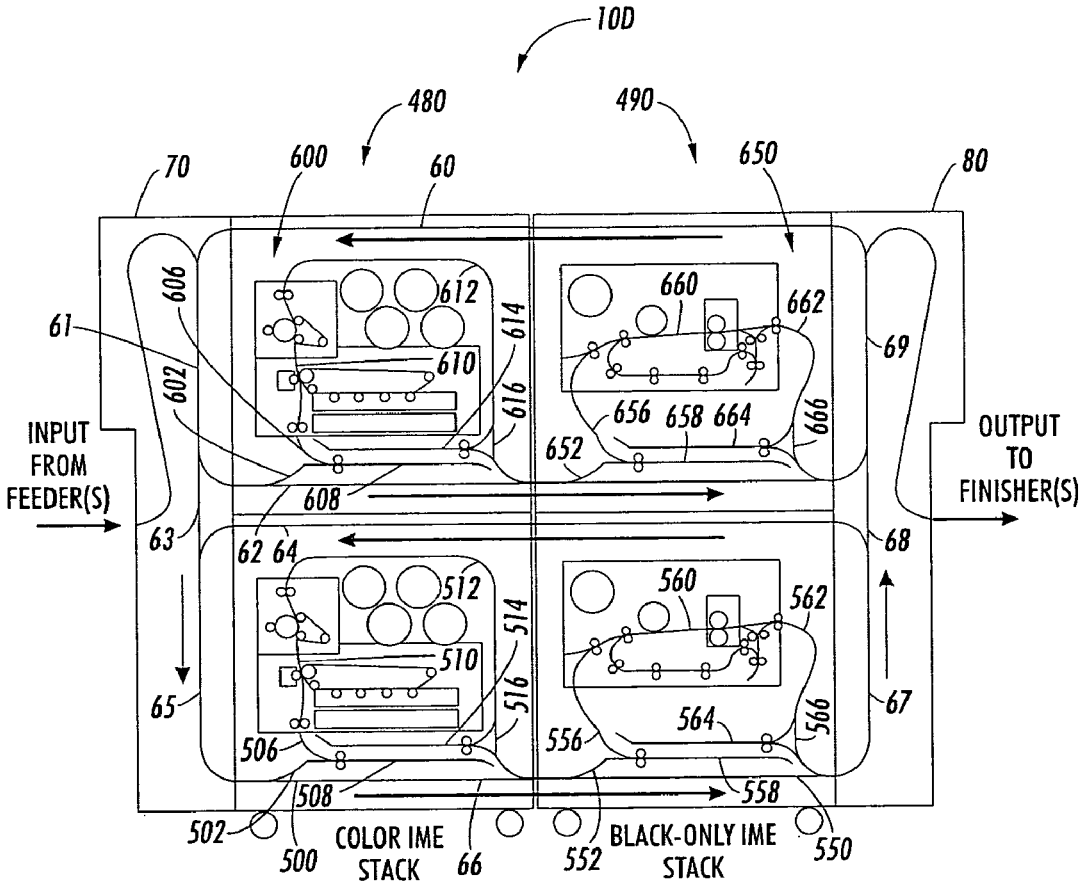
FIG. 4 is a sectional view showing an arrangement of image marking engines according to a fifth embodiment.

Referring now to FIG. 4, another combination of marking engines configured into an integrated printing system 10D is therein illustrated. FIG. 4 displays two color marking engines 500, 600 in a first vertical tower 480 integrated with two black marking engines 550, 650 in a second tower 490. Four separate generally horizontal highways or media paths 60, 62, 64, 66 are displayed along with their respective media passing directions. An upper horizontal return highway 60 moves media from right to left, a central horizontal forward highway 62 moves media from left to right, a central horizontal return highway 64 moves media from right to left, and a lower horizontal forward highway 66 moves media from left to right. An input distributor module 70 positioned to the left of the first marking engine tower 480 accepts sheets from a feeder module (not illustrated) and delivers them to the central forward 62 and lower forward 66 highways. An output module 80, located to the right of the second vertical marking engine tower 490, receives sheets from the central forward 62 and the lower forward 66 highways and delivers them in sequence to a finishing device (not illustrated) or recirculates the media by way of return paths 60, 64.

A key capability shown in FIG. 4 is the ability of media to be marked by any first IME and then by any one or more subsequent IME to enable, for example, single pass duplexing and/or multi-pass printing. The elements that enable this capability are the return highways 60, 64 and the input and output modules 70, 80. The return highways 60, 64 are connected to, and extend between, both input and output modules 70, 80, allowing, for example, media to first be routed to the lower right IME 550, then up to the top of the output module 80, and then back along the upper return highway 60 to the input module 70, and thence to the upper left IME 600.

With reference to one of the marking engines, namely marking engine 500, the media paths will be explained in detail below. The media originating from the input distributor module 70 can enter the lower horizontal forward highway 66 by way of paths 61, 63 and/or 65. It is to be appreciated that the media alternatively can be routed, or recirculated, by way of return highways 60, 64. The media can exit the horizontal highway 66 at highway exit 502. Upon exiting the horizontal highway 66, the media travels into a staging portion or input inverter 508. Thereupon, the media enters the processing portion of marking engine 500 via path 506 and is transported through a processing path 510 of the marking engine 500 whereby the media receives an image. Next, the media exits the processing path 510 at point 512 and can take alternate routes therefrom. Namely, the media can enter another staging portion or output inverter 514 or can travel by way of a bypass path 516 of the output inverter 514 to the horizontal highway 66 for exiting the IME 500.

With reference now to another marking engine, namely marking engine 550, the media paths will be explained in detail below. The media originating from the input distributor module 70, or indirectly from another IME 500, 600, and/or 650, can enter the lower horizontal forward highway 66. It is to be appreciated that the media alternatively can be routed, or recirculated, by way of return highways 60, 64. The media can exit the horizontal highway 66 at highway exit 552, thereupon the media travels into a staging portion or input inverter 558. The media then enters the processing portion of marking engine 550 via path 556 and is transported through a processing path 560 of the marking engine 550 whereby the media receives an image. Next, the media exits the processing path 560 at point 562 and can take alternate routes therefrom. Namely, the media can enter another staging portion or output inverter 564 or can travel via a bypass path 566 of the output inverter 564 to the horizontal highway 66 for exiting the IME 550. Upon exiting IME 550, the media can move by way of path 67 to return highway 64, or can alternatively move by way of paths 68 and 69 to return highway 60 or can exit the output module 80 to a media finisher (not illustrated).

With reference now to another marking engine, namely marking engine 600, the media paths will be explained in detail below. The media originating from the input distributor module 70 can enter the central horizontal forward highway 62 by way of path 61. It is to be appreciated that the media alternatively can be routed, or recirculated, by way of return highway 60. The media can exit the horizontal highway 62 at highway exit 602. Upon exiting the horizontal highway 62, the media travels into a staging portion or input inverter 608. Thereupon, the media enters the processing portion of marking engine 600 via path 606 and is transported through a processing path 610 of the marking engine 600 whereby the media receives an image. Next, the media exits the processing path 610 at point 612 and can take alternate routes therefrom. Namely, the media can enter another staging portion or output inverter 614 or can travel via a bypass path 616 of the output inverter 614 to the horizontal highway 62 for exiting the IME 600.

With reference now to another marking engine, namely marking engine 650, the media paths will be explained in detail below. The media originating from the input distributor module 70, or indirectly from another IME, can enter the central horizontal forward highway 62. It is to be appreciated that the media alternatively can be routed, or recirculated, byway of return highway 60. The media can exit the horizontal highway 62 at highway exit 652. Upon exiting the horizontal highway 62, the media travels into a staging portion or input inverter 658. Thereupon, the media enters the processing portion of marking engine 650 via path 656 and is transported through a processing path 660 of the marking engine 650 whereby the media receives an image. Next, the media exits the processing path 660 at point 662 and can take alternate routes therefrom. Namely, the media can enter another staging portion or output inverter 664 or can travel via a bypass path 666 of the output inverter 664 to the horizontal highway 62 for exiting the IME 650. Upon exiting IME 650, the media can move by way of path 69 to return highway 60 or can exit the output module 80 to a media finisher (not illustrated).

In FIG. 14, the IMEs are shown in arbitrary configurations. Optimal relative locations of the IMEs are dependant upon analysis of customer usage demographics, such as the split between black only duplex versus color duplex jobs frequency.

Figure 5:
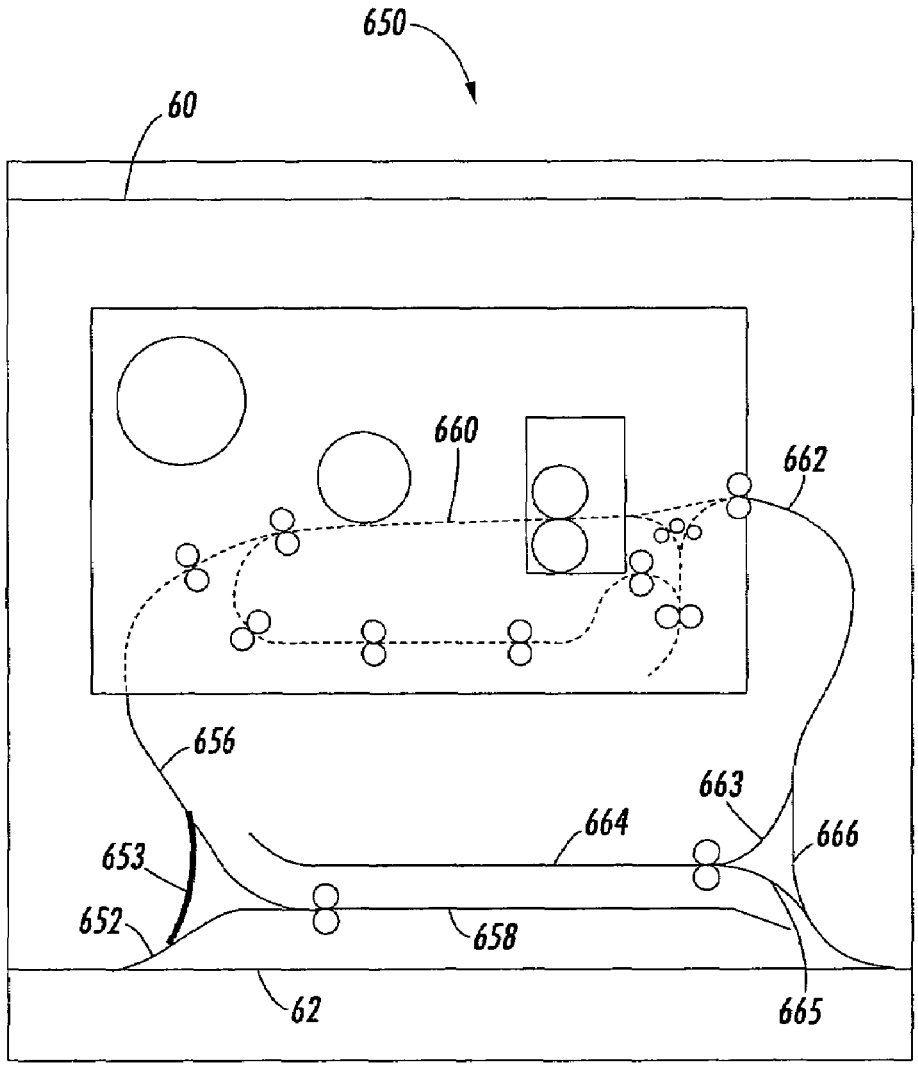
FIG. 5 is a sectional view showing an image marking engine having alternative media transport paths; and, FIG. 6 is a sectional view showing an arrangement of image marking engines according to a sixth embodiment.
Figure 6:
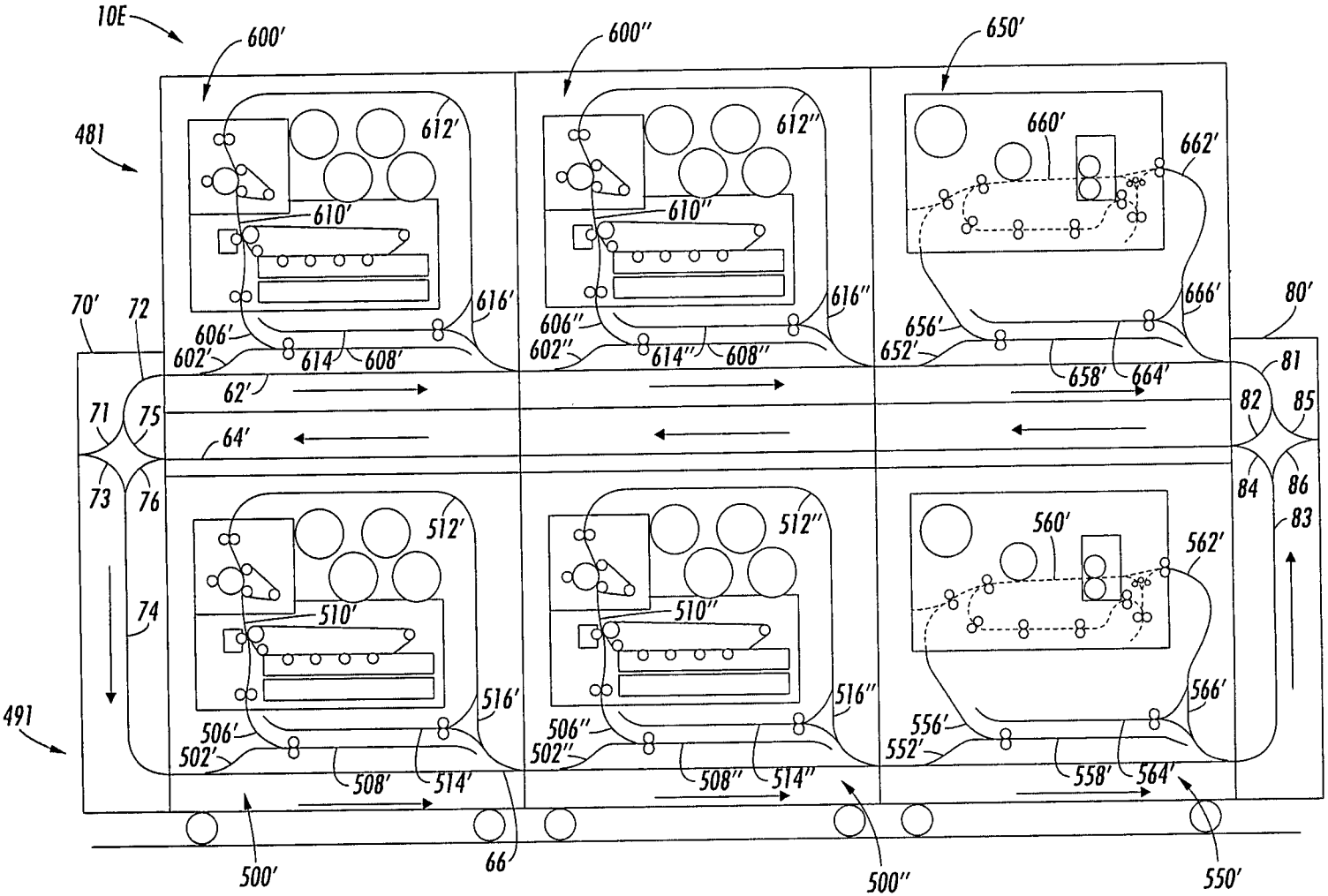

As shown in FIGS. 4–6, each of the marking engines can include a pair of inverter subsystems, for example 658 and 664 (FIGS. 4 and 5). The inverters can serve a function for media entering or exiting a highway: in particular, the inverters invert sheets for duplex printing. Referring now to FIG. 5, it is to be appreciated that each container module paper path could include a bypass path for the input inverter and/or a bypass path for the output inverter. In this manner, media can bypass either or both inverters to enable multi-pass printing. By way of example, IME 650 is shown in FIG. 5 along with a bypass path 653 for the input inverter 658 and the bypass path 666 for the output inverter 664. Media to be inverted by way of output inverter 664, enters by way of path 663 and exits by way of path 665.

The embodiment illustrated in FIG. 6 comprises an alternative arrangement for an integrated printing system 10E wherein the horizontally aligned image marking engines do not include an internal return highway, but rather include an intermediate return highway module which is positioned between vertically oriented image marking engines. Similar elements are identified with single prime (') and double prime (") suffixes and new elements are identified with new numerals. As shown in FIG. 6, paper can be fed from an input distributor module 70' to the upper row of horizontally aligned image marking engines 481, by way of path 71 and 72, or to the lower row of horizontally aligned image marking engines 491, by way of path 73 and 74. Each of the horizontally aligned rows 481, 491 includes a forward highway path 62, 66 positioned below the image marking engines. Upon completing marking and/or bypassing the image marking engines and reaching the end of a row, media can be recirculated to the input distributor module 70' for marking again via another image marking engine. Recirculation from the upper row of horizontally aligned image marking engines 481 is by way of paths 81, 82 and 64'. Recirculation from the lower row of horizontally aligned image marking engines 491 is by way of paths 83, 84 and 64'. Subsequently, the media can be transported to marking engines in rows 481, 491 by way of paths 75, 76.

When all marking has been completed, media is delivered to the output merge module 80' by way of paths 85, 86 and can then be subsequently delivered in sequence to the finishing/stacker portion (not illustrated). As shown in FIG. 6, all of the output inverters include a bypass path (for example 616'). It is to be appreciated that any one or more of the input inverters could also include a bypass. The arrangement shown in FIG. 6 offers shorter overall height because there is one less return highway but it retains the same image marking engine to image marking engine addressability and the same high level of modularity of other embodiments described above (refer to FIG. 4).

The modular architecture of the printing systems described above employ at least two IMEs with associated input/output media paths which can be stacked "two up" utilizing supporting frames to form a basic "two up" module with two marking engines. The modular architecture, refer again to FIGS. 1 and 2, can include at least one additional IME which can be "ganged" together with the two up module in which the horizontal highways can be aligned to transport media to/from the marking engines. The system can include additional horizontal highways positioned above, between, and/or below the ganged marking engines. The exit module can merge the sheets from the highways. The exit module can also provide optional inversion and/or multiple output locations. It is to be appreciated that the highways can move media at a faster transport speed than the internal marking engine paper pass.

The modular media path architecture provides for a common interface and highway geometry which allows different marking engines with different internal media paths together in one system. The modular media path includes entrance and exit media paths which allow sheets from one marking engine to be fed to another marking engine, either in an inverted or in a non-inverted orientation. The modular media path can also involve an internal duplex loop within one marking engine which is optionally provided so that duplex printing can continue even when one or more of the other marking engines are inoperative. The ability to operate "other" IMEs while fixing "one" IME improves system throughput and productivity.

The modular architecture enables a wide range of marking engines in the same system. As described above, the marking engines can involve a variety of types and processing speeds. The modular architecture provides redundancy for marking engines and paths and can provide internal duplex loops for backup. The modular architecture can utilize a single media source on the input side and a single output merging module on the output side. The output merging module can also provide optional inversion, bi-directional media movement, and multiple output locations. It is to be appreciated that a key advantage of the system is that it can achieve very high productivity, using marking processes in elements that do not have to run at high speeds. This simplifies many subsystems such as fusing, and allows use of lower priced marking engines. Although not shown, other versions of the modular architecture can include an odd number of marking engines. For example, three marking engines can be configured such that two are aligned vertically and two are aligned horizontally, wherein one of the marking engines is common to both the vertical and horizontal alignment.

The modular architecture enables single pass duplexing, multi-pass color processing, redundant duplex loops which provide a shorter media path that maximizes reliability and duplex productivity.

The exemplary embodiments have been described with reference to the specific embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

The invention claimed is:

1. An integrated printing system comprising:

at least two generally vertically aligned image marking engines;

at least two generally horizontally aligned image marking engines; and, at least one interface media transport for selectively transporting a series of media sheets to and from said generally vertically aligned and said generally horizontally aligned image marking engines wherein said sheets move selectively to and from at least a first image marking engine and then selectively to any other image marking engine.

2. The integrated printing system of claim 1, wherein said at least one interface media transport is generally horizontal.

3. The integrated printing system of claim 2, wherein said at least one generally horizontal interface media transport is positioned between said at least two generally vertically aligned image marking engines.

4. The integrated printing system of claim 3, wherein said at least one generally horizontal interface media transport extends above said at least two generally horizontally aligned image marking engines.

5. The integrated printing system of claim 2, wherein said at least one generally horizontal interface media transport extends above said at least two generally horizontally aligned image marking engines.

6. The integrated printing system of claim 2, wherein said at least one generally horizontal interface media transport extends below said at least two generally vertically aligned image marking engines.

7. The integrated printing system of claim 2, wherein said at least one generally horizontal interface media transport extends from at least one media feed source to at least one media finishing portion for transporting media in a first direction.

8. The integrated printing system of claim 1, wherein said at least one interface media transport is reversible for transporting media in a first and a second direction.

9. The integrated printing system of claim 7, further including at least another generally horizontal interface media transport for transporting media in said first direction.

10. The integrated printing system of claim 9, further including at least one generally vertical interface media transport extending from said at least one generally horizontal interface media transport to said at least another generally horizontal interface media transport.

11. The integrated printing system of claim 7, further including at least another generally horizontal interface media transport for transporting media in a second direction wherein said sheets move selectively to and from said any other image marking engine to at least a third image marking engine selectively in a downstream and upstream manner.

12. The integrated printing system of claim 11, wherein said first direction and said second direction are generally opposite.

13. The integrated printing system of claim 1, further including one media feed source for introducing media into said printing system.

14. The integrated printing system of claim 1, further including at least one media finishing portion for receiving said sheets from said printing system.

15. The integrated printing system of claim 2, wherein said at least one generally horizontal interface media transport extends below said at least two generally horizontally aligned image marking engines.

16. The integrated printing system of claim 2, wherein said at least one generally horizontal interface media transport extends above said at least two generally vertically aligned image marking engines.

17. The integrated printing system of claim 1, wherein said one image marking engine and said at least another image marking engine are spaced apart from one another.

18. The integrated printing system of claim 2, wherein each said image marking engine includes a media transport for connecting to said at least one generally horizontal interface media transport.

19. The integrated printing system of claim 1, wherein said one image marking engine is a first type and said at least another image marking engine is a second type.

20. The integrated printing system of claim 1, wherein said one image marking engine and said at least another image marking engine are of the same type.

21. An integrated printing system comprising:

at least two generally vertically aligned image marking engines;

at least two generally horizontally aligned image marking engines;

at least one generally horizontal interface media transport for transporting a series of media sheets in a selected order from a first image marking engine to at least a second image marking engine and selectively bypassing at least a third image marking engine in said system.

22. The integrated printing system of claim 21, wherein said first mage marking engine and said at least second image marking engine are spaced apart from one another.

23. The integrated printing system of claim 21, wherein each said image marking engine includes a media transport for connecting to said at least one generally horizontal interface media transport.

24. The integrated printing system of claim 21, wherein said first image marking engine is a first type and said at least second image marking engine is a second type.

25. The integrated printing system of claim 21, wherein said first image marking engine and said at least second image marking engine are of the same type.

26. A method for printing media adapted for a plurality of image marking engines, the method comprising:

providing at least two generally vertically aligned image marking engines;

providing at least two generally horizontally aligned image marking engines;

selectively feeding a series of media sheets from one feed source directly into any one of said generally vertically aligned image marking engines and said generally horizontally aligned image marking engines; and, transporting said media from said generally vertically aligned image marking engines and said generally horizontally aligned image marking engines into at least one media exit portion.

27. The method of claim 26, further including:

providing transports for transporting said media from one image marking engine to another image marking engine.

28. The method of claim 27, wherein transporting said media comprises at least one generally horizontal interface media transport for transporting said media in a first direction.

29. The method of claim 27, further comprising recording on said media images according to image data supplied thereto.

30. The method of claim 27, further comprising recording on one side of said media on said one image marking engine and recording on another side of said media on said another image marking engine.

31. The method of claim 26, further comprising recording on one side of said media on said one image marking engine and recording on another side of said media on same said one image marking engine.

32. The method of claim 30, wherein said recording on said one side and said another side of said media comprises an additional media transport including at least one inverter for inverting said media.

33. The method of claim 32, wherein said at least one inverter is positioned between said one image marking engine and said another image marking engine.

34. The method of claim 27, further comprising recording on one side of said media on said one image marking engine and recording on same said one side of said media on said another marking engine.

35. The method of claim 27, wherein said one image marking engine and said another image marking engine are spaced apart from one another.

36. The method of claim 28, wherein said at least one generally horizontal interface media transport is positioned between said at least two vertically aligned image marking engines.

37. The method of claim 28, wherein said at least one generally horizontal interface media transport is positioned above said at least two vertically aligned image marking engines.

38. The method of claim 28, wherein said at least one generally horizontal interface media transport is positioned below said at least two vertically aligned image marking engines.

39. The method of claim 28, further including another generally horizontal interface media transport for transporting said media in a second direction.

40. The method of claim 39, wherein said first direction is generally opposite to said second direction.

* * * * *